US011286949B2

(12) United States Patent
Kodama et al.

(10) Patent No.: US 11,286,949 B2
(45) Date of Patent: Mar. 29, 2022

(54) WATERPROOF BLOWER FAN

(71) Applicant: SANYO DENKI CO., LTD., Tokyo (JP)

(72) Inventors: Masaki Kodama, Tokyo (JP); Toshiya Nishizawa, Tokyo (JP); Kakuhiko Hata, Tokyo (JP)

(73) Assignee: SANYO DENKI CO., LTD., Tokyo (JP)

( * ) Notice: Subject to any disclaimer, the term of this patent is extended or adjusted under 35 U.S.C. 154(b) by 79 days.

(21) Appl. No.: 16/717,751

(22) Filed: Dec. 17, 2019

(65) Prior Publication Data

US 2020/0208649 A1 Jul. 2, 2020

(30) Foreign Application Priority Data

Dec. 27, 2018 (JP) ..... JP2018-246315

(51) Int. Cl.
*F04D 29/42* (2006.01)
*F04D 17/08* (2006.01)
*F04D 17/16* (2006.01)

(52) U.S. Cl.
CPC ..... *F04D 29/4226* (2013.01); *F04D 17/08* (2013.01); *F04D 17/16* (2013.01); *F05D 2260/602* (2013.01)

(58) Field of Classification Search
CPC ..... F04D 17/08; F04D 17/16; F04D 29/4226; F05D 2260/602
See application file for complete search history.

(56) References Cited

U.S. PATENT DOCUMENTS 4,649,653 A * 3/1987 Ameling ..... F26B 21/08 34/371
5,620,302 A * 4/1997 Garrison ..... F23L 17/005 415/169.2
6,364,628 B1 * 4/2002 Potts ..... F04D 25/02 417/234
6,551,074 B2 * 4/2003 Kudo ..... F04D 25/0613 417/354
2012/0121409 A1 5/2012 Liu et al.
2017/0298959 A1 * 10/2017 Boudreaux ..... F04D 29/703

FOREIGN PATENT DOCUMENTS

DE 102010062976 A1 6/2012
JP 2016075243 A 5/2016

OTHER PUBLICATIONS

German Search Report dated Sep. 22, 2020 for the corresponding German Patent Application No. 102019220079.6.

* cited by examiner

*Primary Examiner* — Ninh H. Nguyen
(74) *Attorney, Agent, or Firm* — Rankin, Hill & Clark LLP

(57) ABSTRACT

A waterproof blower includes a casing and at least four drain holes placed along a circumferential direction of the casing in the outer peripheral wall portion, in the first side wall portion, or in the second side wall portion of the casing. The at least four drain holes communicate with the inside and the outside of the casing. The at least four drain holes each have an opening on an inner side of the casing. The openings of adjacent two drain holes of the drain holes as viewed in a direction of a rotation axis of the impeller are placed at positions where a straight line as a chord linking portions, which are located on the outermost peripheral side of the casing, of opening edges at the shortest distance hardly intersects with the impeller.

5 Claims, 8 Drawing Sheets

FLOW
5
6
7
C
17a, 18a
17b, 18b
17c, 18c
17d, 18d
W
hL
L1
L2
L3
h1
h2
h3

WATERPROOF BLOWER FAN

CROSS-REFERENCE TO RELATED APPLICATION

This application is based on Japanese Patent Application No. 2018-246315 filed with the Japan Patent Office on Dec. 27, 2018, the entire content of which is hereby incorporated by reference.

BACKGROUND

1. Technical Field

One aspect of the present disclosure relates to a waterproof blower fan.

2. Related Art

Waterproof blower fans are conventionally used for purposes that require water resistance and fluid resistance to the entrance of rainwater, chemical solutions, a burst of water, and the like into devices installed outdoor, devices used under bad environments, vehicle-mounted devices, and the like.

A blower fan, not limited to a waterproof blower fan, generally includes a casing, a cylindrical impeller housed rotatably inside the casing, an inlet and outlet provided to the casing, and a motor that rotationally drives the impeller. The casing has at least a first and a second side wall portion provided on both side surfaces of the impeller, an outer peripheral wall portion, and a passage. The outer peripheral wall portion surrounds an outer peripheral surface of the impeller. The outer peripheral wall portion further has a substantially spiral or curved shape. In the outer peripheral wall portion, a distance in the radial direction from a rotation axis of the impeller increases gradually toward a downstream side. The passage is defined by the first side wall portion, the second side wall portion, the outer peripheral wall portion, and an outer peripheral surface portion of the impeller. The passage guides, to the outlet, gas flowing outward in the radial direction from the outer peripheral surface of the impeller.

If such a blower fan is used as a waterproof blower fan as it is in environments that require water resistance and fluid resistance such as those described above, various troubles may occur. For example, an abnormality and failure may occur resulting from the occurrence of a short circuit due to the entrance of water or the like in electric apparatuses such as a motor being a drive source, a control device/circuit for driving the motor, and various sensors. Moreover, the durability of the electric apparatus may be lost due to the deterioration of the material of the electric apparatus. Hence, the electric apparatuses have conventionally been made resistant to water by molding or the like.

However, upon operation of a waterproof blower fan, a liquid such as water may build up inside the casing even if water resistance such as the one described above is ensured, the causes of which include, for example, the intake of a liquid such as water simultaneously with the intake of gas, and condensation (condensation) of a gas including a lot of vapor (such as highly humid air) in the casing of the waterproof blower fan.

During operation where the impeller is being rotationally driven, water or the like that has entered the casing is pushed out by a current of air flowing inside the casing and the rotating impeller, and discharged to the outside from the outlet, or dripped from the inlet. Therefore, water or the like hardly builds up inside the casing. In contrast, when the operation is being stopped (at rest), the flow of the current of air stops, and the rotation of the impeller also stops. Consequently, water or the like that could not be discharged to the outside and has remained inside may build up in a lower part in the vertical direction inside the casing. Consequently, a liquid such as water may build up inside the casing.

When water or the like builds up inside the casing, if the amount of the built-up water or the like is large, a part of the impeller may be immersed in the water or the like. In this case, at the start of the next operation, the built-up water or the like gives high resistance to the rotation of the impeller. As a result, startup failure such as breakage of the impeller and an increase in load at the startup of the motor that drives the impeller may occur.

In order to avoid such a situation, it is known that a waterproof blower fan is installed in such a manner that an outlet of the waterproof blower fan points downward in the vertical direction to discharge water or the like from the outlet. Moreover, it is known to use a drain apparatus such as the one disclosed in JP-A-2016-75243.

SUMMARY

A waterproof blower includes a casing, a cylindrical impeller housed rotatably in the casing, an inlet, and an outlet, which are provided in the casing and a motor configured to rotationally drive the impeller, wherein the casing includes, a first side wall portion and a second side wall portion, which are provided on at least both side surfaces of the impeller, an outer peripheral wall portion that surrounds an outer peripheral surface of the impeller, has a substantially spiral or curved shape, in which a distance in a radial direction from a rotation axis of the impeller increases gradually toward a downstream side, and a passage defined by the first side wall portion, the second side wall portion, the outer peripheral wall portion, and an outer peripheral surface portion of the impeller, the passage being configured to guide, to the outlet, gas flowing outward in the radial direction from the outer peripheral surface of the impeller, the casing further includes at least four drain holes placed along a circumferential direction of the casing in the outer peripheral wall portion, the first side wall portion, or the second side wall portion of the casing, the at least four drain holes communicating between the inside and outside of the casing, the at least four drain holes each having an opening on an inner side of the casing, and the openings of adjacent two drain holes of the drain holes as viewed in a direction of a rotation axis of the impeller are placed at positions where a straight line as a chord linking portions, which are located on the outermost peripheral side of the casing, of opening edges at the shortest distance hardly intersects with the impeller.

DETAILED DESCRIPTION

Figure 1A:
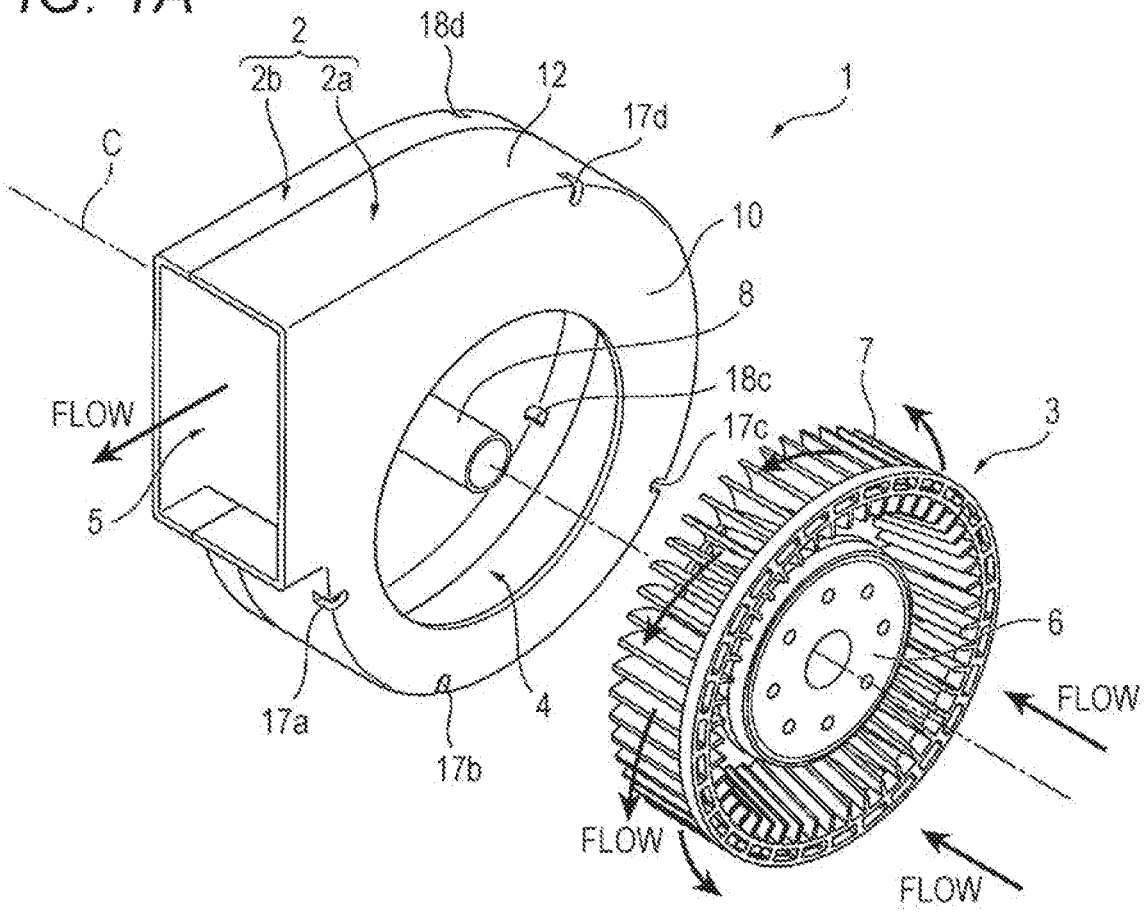
FIG. 1A is a perspective view illustrating a casing and drain holes of a waterproof blower fan according to one embodiment of the present disclosure as viewed from an inlet side.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 9A:
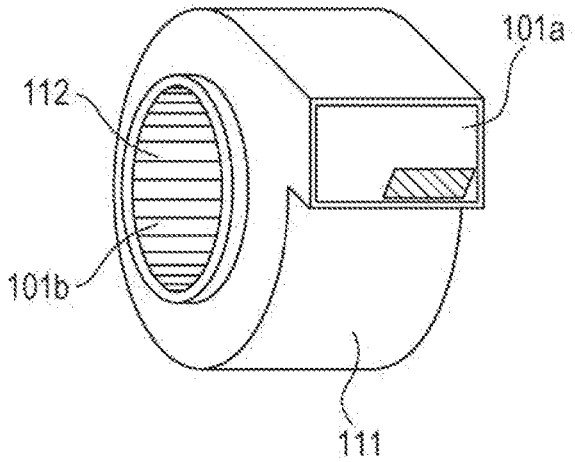
FIGS. 9A and 9B are perspective views of a known waterproof blower fan.
Figure 9B:
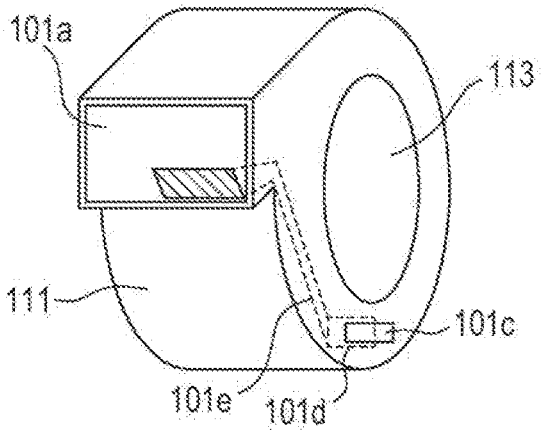

As illustrated in FIGS. 9A and 9B, a centrifugal fan described in JP-A-2016-75243 includes a fan 112, a motor 113 that rotates the fan 112, and a motor drive circuit that drives the motor 113. The centrifugal fan is covered with a fan casing 111. A drain apparatus of the centrifugal fan includes a drain hole 101*c*, a lid 101*d* that can open and close the drain hole, and an open/close mechanism 101*e* for the lid, which are provided to the fan casing 111.

The drain hole 101*c* is located in a gravitational direction of the fan casing 111. In the open/close mechanism 101*e*, the pressure of an air current, an atmospheric pressure difference between the inside and outside of the fan casing, an electromagnetic force, or the like is used to open the lid 101*d* at the stop of the fan.

When the operation of the centrifugal fan is stopped, the open/close mechanism 101*e* opens the lid 101*d* to drain water that has built up inside the fan casing 111. During operation, the open/close mechanism 101*e* is operated to close the lid 101*d*. In this manner, the operation is performed while preventing a reduction in air blowing performance.

The drain apparatus described in JP-A-2016-75243 is an apparatus for avoiding the above-mentioned situation where a liquid such as water builds up inside the casing. However, the drain apparatus requires the openable/closable lid and the open/close mechanism and therefore has a complicated structure. Moreover, the drain apparatus includes the movable portion. Accordingly, the possibility of failure arises. Therefore, the drain apparatus requires high costs related to manufacture and maintenance thereof. Moreover, the drain apparatus requires a space for installation of the open/close mechanism, which leads to a reduction in the layout performance of the waterproof blower fan and an increase in the installation space.

Especially, the drain hole is located in the lowermost part of the casing of the waterproof blower fan in the vertical direction. Accordingly, the direction of the installation of the centrifugal fan needs to be a direction where the position of the drain hole agrees with the gravitational direction. Hence, the centrifugal fan needs to be designed and manufactured in advance in such a manner that the drain hole is placed in the installation direction. Alternatively, for example, the placement of another device and a connecting pipe line needs to be changed to install the centrifugal fan in a predetermined direction. Hence, the layout performance is reduced, and the design and manufacturing costs increase.

One object of the present disclosure is to provide a waterproof blower fan such as the one described below. Drain holes of the waterproof blower fan can prevent a reduction in the water resistance and air blowing performance of the waterproof blower fan. The drain holes have a simple structure without a movable portion. Furthermore, the drain holes improve the layout performance of the waterproof blower fan and hardly have a great impact on the installation space of, and the design and manufacturing costs of the waterproof blower fan.

A waterproof blower fan according to one embodiment of the present disclosure (a present waterproof blower fan) includes a casing, a cylindrical impeller housed rotatably in the casing, an inlet and an outlet, which are provided in the casing, and a motor configured to rotationally drive the impeller, wherein the casing includes a first side wall portion and a second side wall portion, which are provided on at least both side surfaces of the impeller, an outer peripheral wall portion that surrounds an outer peripheral surface of the impeller, has a substantially spiral or curved shape, in which a distance in a radial direction from a rotation axis of the impeller increases gradually toward a downstream side, and a passage defined by the first side wall portion, the second side wall portion, the outer peripheral wall portion, and an outer peripheral surface portion of the impeller, the passage being configured to guide, to the outlet, gas flowing outward in the radial direction from the outer peripheral surface of the impeller, the casing further includes at least four drain holes placed along a circumferential direction of the casing in the outer peripheral wall portion, the first side wall portion, or the second side wall portion of the casing, the at least four drain holes communicating between the inside and outside of the casing, the at least four drain holes each having an opening on an inner side of the casing, and the openings of adjacent two drain holes of the drain holes as viewed in a direction of a rotation axis of the impeller are placed at positions where a straight line as a chord linking portions, which are located on the outermost peripheral side of the casing, of opening edges at the shortest distance hardly intersects with the impeller.

In the waterproof blower fan, the water level of water (built-up water) building up on a lower side in the vertical direction inside the casing rises up to no higher than a constant water level due to drainage of the water from the drain holes when the operation is stopped (at rest) even if the waterproof blower fan is installed in any direction. Therefore, the impeller of the waterproof blower fan hardly touches the built-up water. Consequently, a part of the impeller is substantially not immersed in the water. Therefore, at the start of the next operation, resistance to the rotation of the impeller hardly occurs. Hence, the breakage of the impeller, and an increase in load at the startup of the motor that drives the impeller can be prevented.

Moreover, the configuration provided for drainage is the drain holes having no movable portion. The drain holes have a simple structure. Therefore, the drain holes can improve the layout performance of the waterproof blower fan. Furthermore, the drain holes can prevent increases in installation space and design and manufacturing costs of the waterproof blower fan.

Furthermore, the size of the drain hole is simply required to be an appropriate size just enough that built-up water is smoothly flowed out. In terms of the number of drain holes, at least four drain holes suffice. The number of drain holes may be a number that does not have a great influence on the air blowing performance and quiet performance of the waterproof blower fan.

Here, the "positions where the straight line hardly intersects with the impeller" in the technology of the present disclosure include a position where the straight line does not intersect with the impeller strictly in mathematics, and also include a position where the straight line intersects with the impeller within predetermined limits that substantially do not interfere with the startup of the waterproof blower fan and within design tolerance limits.

Moreover, "water" in terms such as "waterproof", "water", and "built-up water" includes water and liquids in general other than water irrespective of the magnitude of viscosity as long as the object of the present disclosure can be achieved.

Moreover, including the first side wall portion, the second side wall portion, and the outer peripheral wall portion indicates the existence of these wall portions for defining the passage. This does not limit members themselves forming the wall portions as in a case where the number of members forming the side wall portions is two and the number of members forming the outer peripheral wall portion is one. For example, the first side wall portion, the second side wall portion, and the outer peripheral wall portion may be one integrally-molded member, or a combination of a plurality of members. In short, it is simply required to ensure a space where gas flows with the first side wall portion, the second side wall portion, and the outer peripheral wall portion.

Figure 1B:
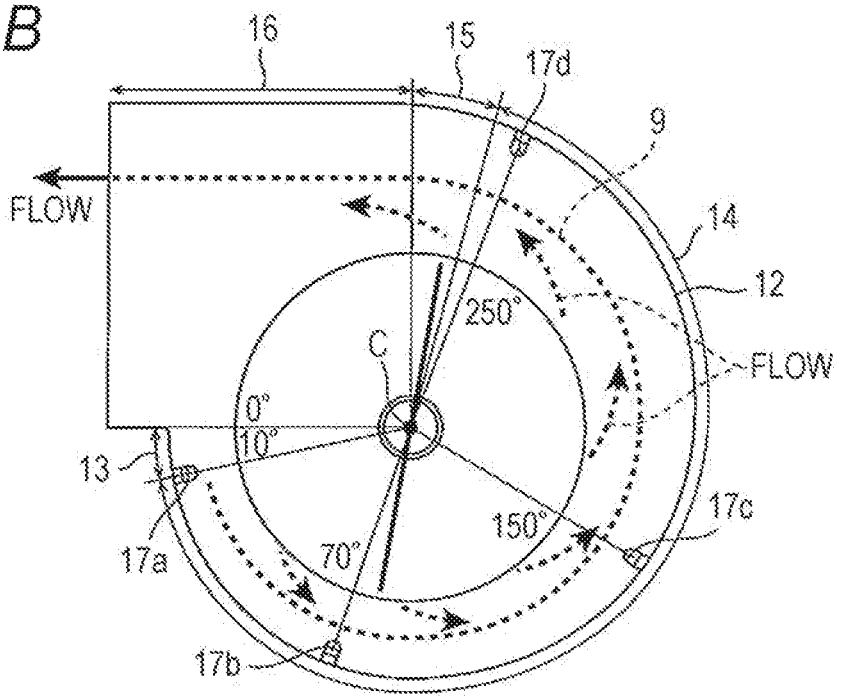
FIG. 1B is a front view (the inlet side) of the same.

FIG. 1A is a perspective view illustrating a casing and drain holes of a waterproof blower fan according to one embodiment of the present disclosure as viewed from an inlet side, and FIG. 1B is a front view (the inlet side) of the same.

Figure 2A:
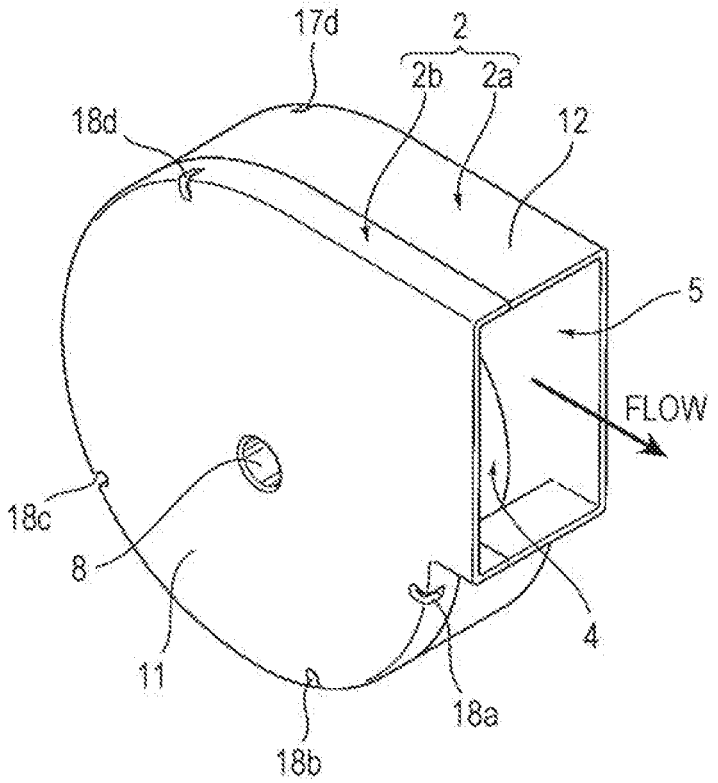
FIG. 2A is a perspective view illustrating the casing and the drain holes of the waterproof blower fan according to one embodiment of the present disclosure as viewed from a nameplate side.
Figure 2B:
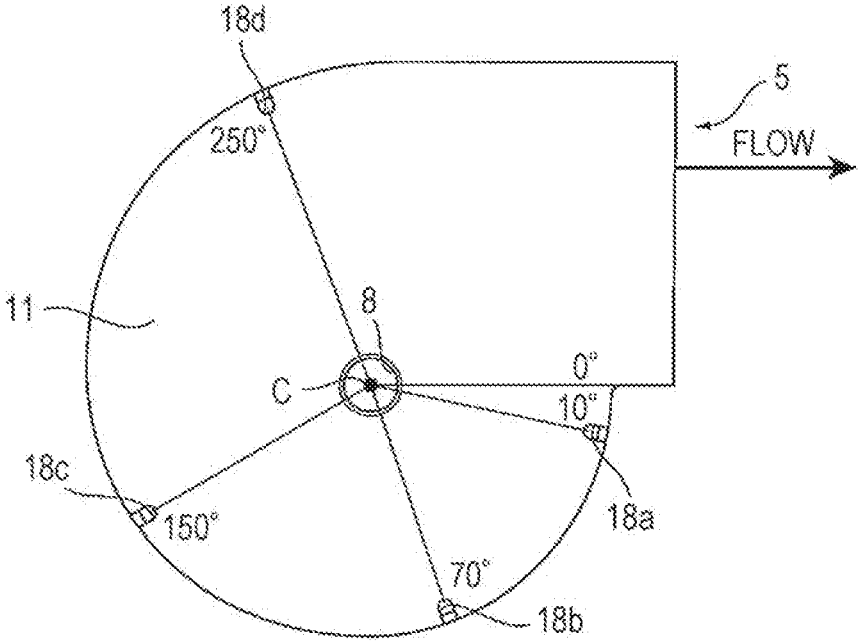
FIG. 2B is a front view (the nameplate side) of the same.

FIG. 2A is a perspective view illustrating the casing and the drain holes of the waterproof blower fan according to one embodiment of the present disclosure as viewed from a nameplate side, and FIG. 2B is a front view (the nameplate side) of the same.

The entire structure of a waterproof blower fan to which drain holes of the waterproof blower fan of the embodiment are applied is described first on the basis of FIGS. 1A and 1B and FIGS. 2A and 2B.

A waterproof blower fan 1 according to the embodiment includes a casing 2, a cylindrical impeller 3 having a plurality of blades 7, the impeller 3 being housed rotatably in the casing 2, an inlet 4 and an outlet 5, which are provided to the casing 2, and a motor 6 that rotationally drives the impeller 3. In the specification, the entire configuration of the waterproof blower fan 1 is not illustrated since it is obvious to those skilled in the art.

In the waterproof blower fan 1 according to the embodiment, the cylindrical impeller 3 is inserted onto a rotor cover of the motor 6. The motor 6 includes a rotating shaft that is inserted into and supported by a central axis support 8 inside the casing 2 with a bearing so as to be rotatable.

A rotor part (not illustrated), which includes a magnet, of the motor 6 is integrally formed inside the rotor cover of the motor 6, and a stator part (not illustrated), which includes a wiring portion, of the motor 6 is placed with clearance. The stator part is fitted to an outer side of the central axis support of the casing 2.

The liquid-tightness of the stator part, which is fitted to the outer side of the central axis support 8 of the casing 2, of the motor 6, and a control board is ensured by molding. Consequently, the occurrence of an abnormality or failure in an electrical component resulting from the occurrence of a short circuit in the electrical component, and the loss of durability of an electrical component resulting from the deterioration of the material are prevented.

The casing 2 includes the inlet 4, the impeller 3 having the plurality of blades 7 provided on an outer peripheral portion, a passage 9, and the outlet 5 along a direction of the flow (flow) of gas. The passage 9 guides, to the outlet 5, the gas sent outward in a radial direction from an outer peripheral surface of the impeller 3. In order to form the passage 9, the casing 2 includes at least an inlet-side side wall portion (first side wall portion) 10, a nameplate-side side wall portion (second side wall portion) 11, and an outer peripheral wall portion 12. The inlet-side side wall portion (first side wall portion) 10 and the nameplate-side side wall portion (second side wall portion) 11 are provided on both side surfaces, which are orthogonal to a rotation axis C of the impeller 3, of the casing 2. The outer peripheral wall portion 12 surrounds an outer periphery of the impeller 3 in a cross section orthogonal to the rotation axis C of the impeller 3. Furthermore, the outer peripheral wall portion 12 has a substantially spiral or curved shape, and a distance in the radial direction from the rotation axis C increases gradually toward a downstream side in the outer peripheral wall portion 12.

The nameplate side is a side where a nameplate is attached or installed, and indicates a side opposite to the inlet side. The nameplate is a plate for displaying the manufacturer, the output, the model, other specifications, and the like of the waterproof blower fan 1.

The inlet 4 is a circular opening provided in the inlet-side side wall portion 10. The inlet 4 is provided to draw fluid from the outside through the inlet-side side wall portion 10 in a direction of the rotation axis C. The inlet 4 is formed in such a manner that a diameter of the inlet 4 with the rotation axis C as the center is substantially the same as, or smaller than, an inner diameter of the cylindrical impeller 3.

The outlet 5 includes an opening having a substantially rectangular cross section. The outlet 5 is connected to the above-mentioned passage 9. The passage 9 is defined by the inlet-side side wall portion 10, the nameplate-side side wall portion 11, the outer peripheral wall portion 12, and an outer peripheral surface portion of the impeller 3.

As illustrated in detail in FIG. 1B, the passage 9 includes a main section 14, a connection section 15, and an outlet section 16 in turn toward the downstream side along the direction of the flow of gas. The passage 9 has a cross-sectional shape such as the one described below. In the main section 14, the cross-sectional area of the passage 9 increases gradually toward the downstream side. In the connection section 15, the cross-sectional area of the passage 9 is substantially constant. In the outlet section 16, the cross-sectional area of the passage 9 increases sharply. These sections are continuously connected to smoothly guide the sent gas to the outlet 5.

A sealing section 13 is formed between the uppermost stream side of the main section 14 and the outlet 5. The sealing section 13 is a section that blocks between the uppermost stream side of the passage 9 and the outlet 5. The above passage 9 substantially does not include the sealing section 13. The sealing section 13 may be omitted or reduced if necessary. In other words, the outer peripheral surface portion of the impeller 3 may be configured in such a manner that substantially the entire part thereof forms the passage 9.

The main section 14 is described in detail. In the main section 14, an outer peripheral side of the passage 9 is defined by the outer peripheral wall portion 12 as viewed in the direction of the rotation axis C of the waterproof blower fan 1, that is, as viewed in a cross section orthogonal to the rotation axis C of the impeller 3. The outer peripheral wall portion 12 surrounds the outer periphery of the impeller 3, and has a spiral or curved shape. In the outer peripheral wall portion 12, the distance in the radial direction from the rotation axis C increases gradually with the angle of rotation along the direction toward the downstream side. On the other hand, an inner peripheral side of the passage 9 is defined by the outer peripheral surface portion of the impeller 3. The passage 9 is formed so as to have a substantially rectangular cross section orthogonal to a flow line of the passage 9, and have a cross-sectional area that increases gradually with the angle of rotation.

The above shape of the outer peripheral wall portion 12 does not need to be strictly spiral or curved in mathematics, and may be a shape obtained by approximating at least a part thereof by a straight line. In other words, the outer peripheral wall portion 12 may have any shape as long as it is a shape formed on the basis of normal design of the waterproof blower fan 1.

The connection section 15 for smoothing the flow of gas is provided between the main section 14 of and the outlet section 16, which is described below, of the passage 9. In the connection section 15, an outer peripheral side of the passage 9 is defined by the substantially arc-shaped outer peripheral wall portion 12 that surrounds the outer periphery of the impeller 3 as viewed in the direction of the rotation axis C of the waterproof blower fan 1, that is, as viewed in a cross section orthogonal to the rotation axis C of the impeller 3. On the other hand, an inner peripheral side of the passage 9 is defined by the outer peripheral surface portion of the impeller 3 as in the main section 14. The passage 9 is formed so as to have a substantially rectangular cross section orthogonal to the flow line of the passage 9, and have a substantially constant cross-sectional area irrespective of the angle of rotation.

The outlet section 16 is provided between the connection section 15 of the passage 9 and the outlet 5. In the outlet section 16, an outer peripheral side of the passage 9 is defined by the straight outer peripheral wall portion 12 that is substantially parallel to a straight line extending in a substantially tangent direction from the outer periphery of the impeller 3 as viewed in the direction of the rotation axis C of the waterproof blower fan 1, that is, as viewed in a cross section orthogonal to the rotation axis C of the impeller 3. On the other hand, an inner peripheral side of the passage 9 on an upstream side is defined by the outer peripheral surface portion of the impeller 3. The inner peripheral side of the passage 9 on the downstream side is defined by a straight inner wall portion that is substantially parallel to the outer peripheral wall portion 12, or expands toward the outlet 5. The passage 9 is formed so as to have a substantially rectangular cross section orthogonal to the flow line of the passage 9, and have a cross-sectional area that increases toward the outlet 5.

Kinetic energy is given by the blades 7 of the rotating impeller 3 to the fluid that has been drawn from the inlet 4 in the direction of the rotation axis C of the impeller 3 and has been flowed into the inner space of the impeller 3. The gas then passes between the blades 7 of the rotating impeller 3 and is sent to the outer periphery of the impeller 3. The gas sent to the outer periphery flows through the above passage 9 and is discharged from the outlet 5 to the outside.

As illustrated in FIGS. 2A and 2B, instead of the inlet 4, a wall surface where a nameplate can be attached or installed is formed on the nameplate-side side wall portion 11 unlike the inlet-side side wall portion 10. In addition, the nameplate-side side wall portion 11 includes a structure that is symmetric to a structure of the inlet-side side wall portion 10 with respect to a plane cut along the middle of the outer peripheral wall portion 12 in a width direction thereof.

As can be seen from FIGS. 1A and 2A, one casing 2 is formed by combining two split members 2*a* and 2*b* along a parting plane being a plane orthogonal to the rotation axis C in the outer peripheral wall portion 12. The casing split member 2*a* on the inlet side includes the inlet-side side wall portion 10 and a part of the outer peripheral wall portion 12. The casing split member 2*b* on the nameplate side includes the nameplate-side side wall portion 11 and the remaining part of the outer peripheral wall portion 12.

The parting plane of the casing 2 is provided closer to the nameplate-side side wall portion 11. Since the inlet-side side wall portion 10 includes the inlet 4 with a large diameter while substantially the entire surface of the nameplate-side side wall portion 11 is blocked, this structure is a structure where a difference in, for example, strength in a case where they are made of the same material is considered. Naturally, the position of the parting plane of the casing 2 is arbitrary. The parting plane may be formed precisely in the middle of the outer peripheral wall portion 12 in the width direction. Alternatively, the parting plane may be provided closer to the inlet-side side wall portion 10 opposite to the embodiment. Moreover, the casing 2 can also be configured including three or more casing split members.

The above description relates to the entire structure of the waterproof blower fan 1 and the configuration of the casing 2. Upon implementation of the technology of the present disclosure, it is natural to be also able to employ a structure different from the above structure as long as the structure is known in a general blower fan technical field.

FIGS. 1B and 2B illustrate drain holes 17*a* to 17*d* and drain holes 18*a* to 18*d* according to the embodiment of the present disclosure. As illustrated in the drawings, corner portions where both the side wall portions 10 and 11 are in contact with the outer peripheral wall portion 12 in the casing 2 in the embodiment are provided with the eight drain holes 17*a* to 17*d* and 18*a* to 18*d* that cause the inside and outside of the casing 2 to communicate with each other. Each of these drain holes 17*a* to 17*d* and 18*a* to 18*d* includes an opening in the inside (and the outside) of the casing 2.

In terms of these drain holes 17*a* to 17*d* and 18*a* to 18*d*, the inlet-side side wall portion 10 of the casing 2 is provided with drain holes (parts of the drain holes 17*a* to 17*d*, or notch portions). Opposing drain holes (the other parts of the drain holes 17*a* to 17*d*, or notch portions) are provided on the inlet-side side wall portion 10 side of the outer peripheral wall portion 12 so as to be at the same angular positions as the parts of the drain holes 17*a* to 17*d* about the rotation axis C. The corresponding drain holes, that is, the parts of the drain holes 17*a* to 17*d* and the other parts of the drain holes 17*a* to 17*d*, communicate with each other in pairs at the corner portion formed by the inlet-side side wall portion 10 and the outer peripheral wall portion 12 to form the drain holes 17*a* to 17*d* as integral hole spaces.

Moreover, the nameplate-side side wall portion 11 of the casing 2 is provided with drain holes (parts of the drain holes 18*a* to 18*d*, or notch portions). Furthermore, opposing drain holes (the other parts of the drain holes 18*a* to 18*d*, or notch portions) are provided on the nameplate-side side wall portion 11 side of the outer peripheral wall portion 12 so as to be at the same angular positions as the parts of the drain holes 18*a* to 18*d* about the rotation axis C. The corresponding drain holes, that is, the parts of the drain holes 18*a* to 18*d* and the other parts of the drain holes 18*a* to 18*d*, communicate with each other in pairs at the corner portion formed by the nameplate-side side wall portion 11 and the outer peripheral wall portion 12 to form the drain holes 18*a* to 18*d* as integral hole spaces.

As described below, the drain holes 17*a* to 17*d* and 18*a* to 18*d* formed as the integral hole spaces as described above form hole spaces having an equal or unequal angle cross section in cross sections that are parallel to the rotation axis C and pass the rotation axis C and the drain holes 17*a* to 17*d* and 18*a* to 18*d*. The shape of an unequal angle includes an L shape. In other words, the drain holes 17*a* to 17*d* and 18*a* to 18*d* form spaces having a cross section of the equal or unequal angle shape.

If the casing 2 is formed combining the casing split member 2*a* on the inlet side and the casing split member 2*b* on the nameplate side as in the embodiment, it is possible to simplify the manufacture and assembly step of forming the parts of the drain holes 17*a* to 17*d* and the parts of the drain holes 18*a* to 18*d*, which are provided in both the side wall portions 10 and 11 of the casing 2, and the other parts of the drain holes 17*a* to 17*d* and the other parts of the drain holes 18*a* to 18*d*, which are provided in the outer peripheral wall portion 12.

In terms of the number of plurality of drain holes 17*a* to 17*d* and 18*a* to 18*d* provided to the casing 2, each of the inlet-side side wall portion 10 and the nameplate-side side wall portion 11 is provided with four drain holes. Moreover, the outer peripheral wall portion 12 is provided with four drain holes on each of the side in contact with the inlet-side side wall portion 10, and the side in contact with the nameplate-side side wall portion 11. Therefore, 16 drain holes are provided in total. Regarding this, as described above, the corresponding drain holes communicate with each other in pairs at the corner portions formed by both the side wall portions 10 and 11 and the outer peripheral wall portion 12 to form the drain holes as the integral hole spaces. Therefore, the seemingly eight drain holes 17*a* to 17*d* and 18*a* to 18*d* are provided.

In the illustrated embodiment, the eight drain holes 17*a* to 17*d* and 18*a* to 18*d* are provided at the following positions: in other words, when the direction of the outlet 5 is the direction of the normal to an opening surface of the outlet 5, assuming, in this case, the direction of a horizontal line extending parallel to the direction of the outlet 5 from the rotation axis C toward the outlet 5 is a reference direction, the eight drain holes 17*a* to 17*d* and 18*a* to 18*d* are provided around portions of the casing 2 at rotation angles of approximately 10 degrees, approximately 70 degrees, approximately 150 degrees, and approximately 250 degrees with reference to the reference direction as viewed in a counterclockwise direction about the rotation axis C.

Figures 3A, 3B, 3C:
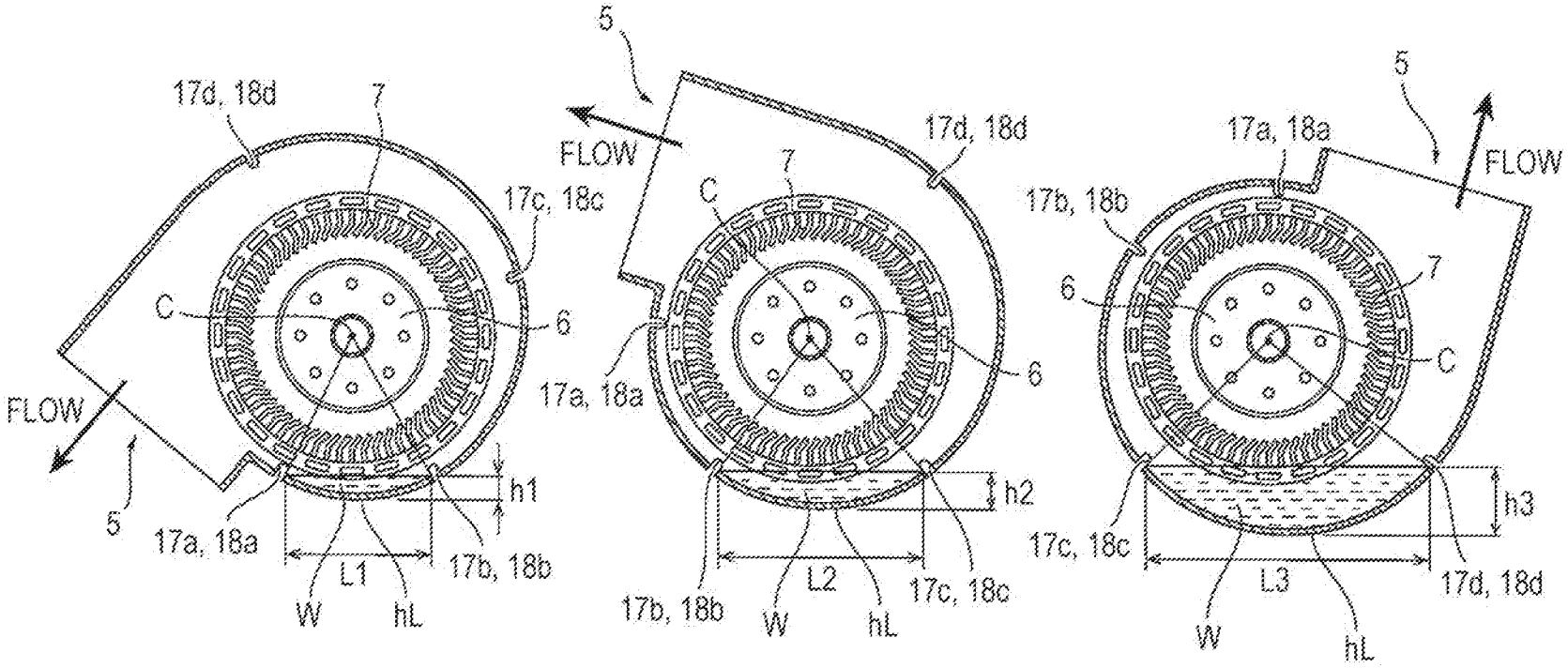
FIGS. 3A to 3C are cross-sectional views illustrating a relationship between an impeller, the drain holes, and the water level of built-up water in the waterproof blower fan according to one embodiment of the present disclosure.

FIGS. 3A to 3C illustrate a relationship between the impeller 3, the drain holes 17*a* to 17*d*, the drain holes 18*a* to 18*d*, and the water level of built-up water W in a case where such eight drain holes 17*a* to 17*d* and 18*a* to 18*d* are provided.

All of FIGS. 3A to 3C illustrate states of the waterproof blower fan 1 at rest where the operation of the waterproof blower fan 1 has been stopped, the rotation of the impeller 3 has stopped, and the water level of the built-up water W has become stable. FIGS. 3A to 3C illustrate states where water has built up, and the built-up water W exists in the lowermost part of the casing 2 in the vertical direction when the up-and-down direction in FIGS. 3A to 3C is set as the vertical direction.

Openings of adjacent two drain holes among the drain holes 17*a* to 17*d* and 18*a* to 18*d* as viewed in the direction of the rotation axis C are placed at positions where a straight line (segment) with a length L1, L2, or L3 as a chord linking portions, which are located on the outermost side of the casing 2, of opening edges at the shortest distance does not intersect with the impeller 3.

These positions of the adjacent two drain holes are positions such as those described above. In other words, it is assumed that the casing 2 is installed in such a manner that a substantially middle portion of the straight line with the length L1, L2, or L3 as the chord between the two drain holes among the drain holes 17*a* to 17*d* and 18*a* to 18*d* is located on a line extending in the vertical direction, the line passing the rotation axis C. In this case, the above positions of the openings of the adjacent two holes are positions where a water level h1, h2, or h3 of the built-up water W remaining in the casing 2, the built-up water W being difficult to flow out of both of the adjacent two drain holes, is a water level where the built-up water W substantially does not touch the impeller 3 that is rotationally driven. The water level h1, h2, or h3 of the built-up water W indicates the height of the built-up water W from a bottom-most portion hL to the water surface.

There is also a case where the middle portion of the straight line with the length L1, L2, or L3 as the chord linking the adjacent two drain holes among the drain holes 17*a* to 17*d* and 18*a* to 18*d* at the shortest distance is not located on the line extending in the vertical direction, the line passing the rotation axis C. In this case, the built-up water W flows out of one in the adjacent two drain holes among the drain holes 17*a* to 17*d* and 18*a* to 18*d*. Hence, the water level of the built-up water W falls below the above water level h1, h2, or h3. Therefore, the built-up water W substantially does not touch the impeller 3.

In this manner, positions of adjacent two drain holes among the drain holes 17*a* to 17*d* and 18*a* to 18*d* are determined. In other words, the positions of eight drain holes 17*a* to 17*d* and 18*a* to 18*d* in total, at least four on each side wall portion side, are determined. The drain holes 17*a* to 17*d* and 18*a* to 18*d* are placed (formed) at the determined positions. Accordingly, the water level of the water surface of the built-up water W is a water level where the built-up water W substantially does not touch the impeller 3 even if the outlet 5 of the casing 2 is oriented in any direction.

See examples illustrated in FIGS. 3A to 3C specifically. In FIG. 3A, the outlet 5 is installed so as to point to the bottom left of the drawing. In this example, a straight line with the length L1 as a chord linking portions of opening edges, which are located on the outermost peripheral side, of the drain hole 17*a* (18*a*) and the drain hole 17*b* (18*b*) at the shortest distance is located at the water level h1 being the height from the bottom-most portion hL as viewed in the vertical direction. Even if the water level of the built-up water W rises above that position of the straight line, the built-up water W flows out of the drain holes 17*a*, 18*a*, 17*b*, and 18*b* to the outside. Accordingly, the highest water level hardly exceeds the water level h1.

The above-mentioned straight line with the length L1, L2, or L3 as the chord here is a straight line not only linking portions, which are located on the outermost peripheral side, of opening edges but also linking these portions at the shortest distance. The reason for this is as follows: if the drain holes 17*a* to 17*d* and 18*a* to 18*d* are provided in the outer peripheral wall portion 12, the openings of the drain holes 17*a* to 17*d* and 18*a* to 18*d* have a predetermined width along a circumferential direction, which indicates the existence of a plurality of chords (straight lines) with different lengths linking portions, which are located on the outermost peripheral side, of opening edges; and considering this, the straight lines with the lengths L1 to L3 linking these portions at the shortest distances are determined.

Similarly, FIGS. 3B and 3C illustrate the states of the built-up water W in the waterproof blower fan 1 installed in such a manner that the outlet 5 points to the top left and top right of the drawings by being rotated in turn in a clockwise direction.

In FIG. 3B, the waterproof blower fan 1 is installed in such a manner that the outlet 5 points to the top left of the drawing. The straight line with the length L2 as the chord determined by the drain hole 17*b* (18*b*) and the drain hole 17*c* (18*c*) is located at the water level h2 as the highest water level. Moreover, in FIG. 3C, the waterproof blower fan 1 is installed in such a manner that the outlet 5 points to the top right of the drawing. The straight line with the length L3 as the chord determined by the drain hole 17*c* (18*c*) and the drain hole 17*d* (18*d*) is located at the water level h3 as the highest water level.

As a result, the drain holes 17*a* to 17*d* and 18*a* to 18*d* placed in this manner are provided at irregular intervals. The relationship between the water levels h1 to h3 being the highest water levels are h3>h2>h1. The relationship of the length of the chord is L3>L2>L1.

The reasons for this are the following points: the outer peripheral wall portion 12 of the passage 9 of the casing 2 surrounds the outer periphery of the impeller 3 as viewed in the direction of the rotation axis C of the impeller 3; furthermore, the outer peripheral wall portion 12 has a substantially spiral or curved shape, and the distance in the radial direction from the rotation axis C increases gradually toward the downstream side with the angle of rotation in the outer peripheral wall portion 12.

The outer peripheral wall portion 12 has such a shape; consequently, the distance between the outer peripheral surface of the impeller 3 and the outer peripheral wall portion 12 in the direction of the normal to the outer peripheral surface of the impeller 3 increases gradually toward the downstream side of the passage 9. The allowable water level h where the built-up water W substantially does not touch the impeller 3 increases accordingly.

The outlet 5 (the waterproof blower fan 1) can also be installed in such a manner that the outlet 5 points in a direction different from the orientations of the outlet 5 illustrated in FIGS. 3A to 3C. In this case, the built-up water W further flows out of a part of the drain holes 17*a* to 17*d* and 18*a* to 18*d* to the outside until the operation of the waterproof blower fan 1 is stopped, the rotation of the impeller stops, and the water level of the built-up water W enters a stably still state. Hence, the highest water level falls further below the above water levels h1, h2, and h3. Although not illustrated, if the waterproof blower fan 1 is installed in such a manner that the outlet 5 points downward in the vertical direction, the built-up water W flows out of the outlet 5 as in before. Hence, water hardly builds up.

The orientation of the outlet 5 can be changed according to the installation form of the waterproof blower fan 1. For example, the orientation of the outlet 5 may be not only the direction rotated about the rotation axis C of the impeller 3 but also a direction inclined with reference to an axis orthogonal to the rotation axis C of the impeller 3. However, distances (side clearance) between the impeller 3 and both the side wall portions 10 and 11 are shorter than the distance between the outer peripheral surface of the impeller 3 and the outer peripheral wall portion 12 in the direction of the normal to the outer peripheral surface of the impeller 3. As a result, if the orientation of the outlet 5 is the direction inclined with reference to the axis orthogonal to the rotation axis C of the impeller 3, the allowable water level is likely to be low. Hence, it is preferable that the incline be small. However, the structure of the drain holes of the embodiment works effectively as long as the incline is an incline of some degree.

Here, the outlet 5 is located further downstream of the drain holes 17*d* and 18*d*, and also has the draining function. Hence, it seems that it is also necessary to similarly consider a positional relationship between the outlet 5 and these drain holes 17*d* and 18*d* adjacent to the outlet 5. However, in reality, a portion of the passage 9 between the outlet 5 and the drain holes 17*d* and 18*d* adjacent to the outlet 5 is a portion whose cross section has the largest or a considerably large area in the passage 9. As a result, the distance between the outer peripheral wall portion 12 of the casing 2 and the outer peripheral surface portion of the impeller 3 is also increased in this portion. Therefore, if water builds up in this position, the built-up water W results in flowing out of the outlet 5 before the water level of the built-up water W rises. Hence, there is hardly any necessity of considering the positional relationship between the outlet 5 and these drain holes 17*d* and 18*d* adjacent to the outlet 5.

The water level of the built-up water W where the built-up water W substantially does not touch the impeller 3 changes according to the change in the distance between the outer peripheral wall portion 12 of the casing 2 and the outer peripheral surface portion of the impeller 3. Hence, the number of drain holes 17*a* to 17*d* and 18*a* to 18*d* can be changed according to the shape of the casing 2. Moreover, the number of drain holes 17*a* to 17*d* and 18*a* to 18*d* may be increased as appropriate within the range where the built-up water W substantially does not touch the impeller.

Figure 6B:
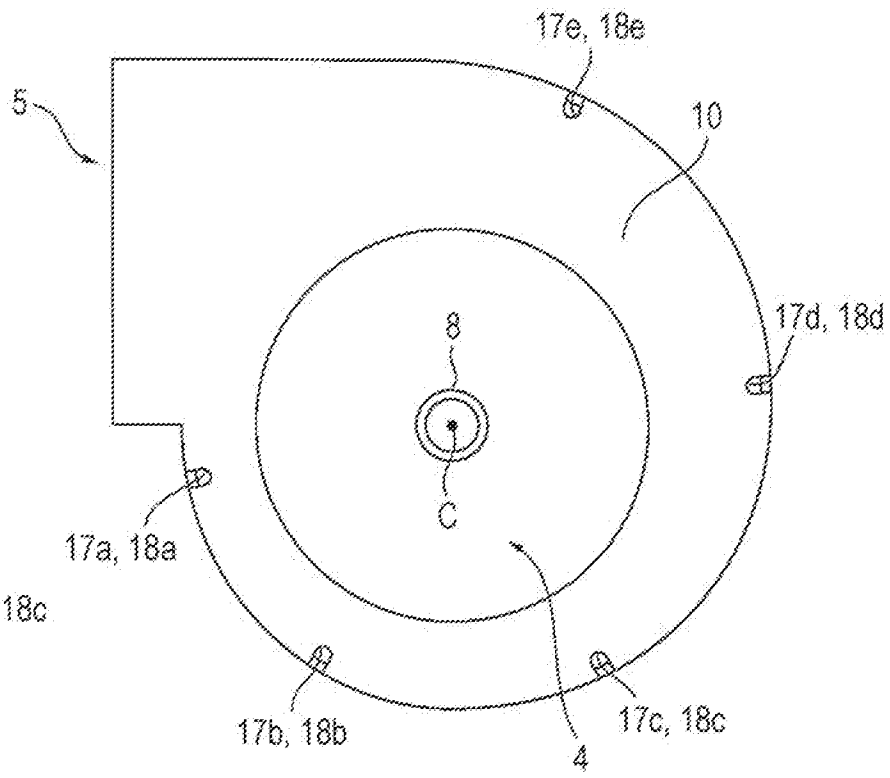
FIGS. 6A and 6B are front views illustrating aspects of placement of the drain holes of the waterproof blower fan according to one embodiment of the present disclosure.

For example, if the distance between the outer peripheral wall portion 12 of the casing 2 and the outer peripheral surface portion of the impeller 3 is reduced (narrowed), not four but five drain holes 17*a* to 17*e* and five drain holes 18*a* to 18*e* may be provided (refer to FIG. 6B). Alternatively, five or more drain holes may be provided. In terms of the structure of the drain holes 17*a* to 17*e* and 18*a* to 18*e*, as in the embodiment, portions of the corresponding drain holes 17*a* to 17*e* (18*a* to 18*e*) may communicate with each other in pairs at the corner portions formed by the side wall portion 10 (11) and the outer peripheral wall portion 12 to form the drain holes 17*a* to 17*e* (18*a* to 18*e*) as integral hole spaces. In this case, the seeming number of drain holes is 10.

Figure 4:
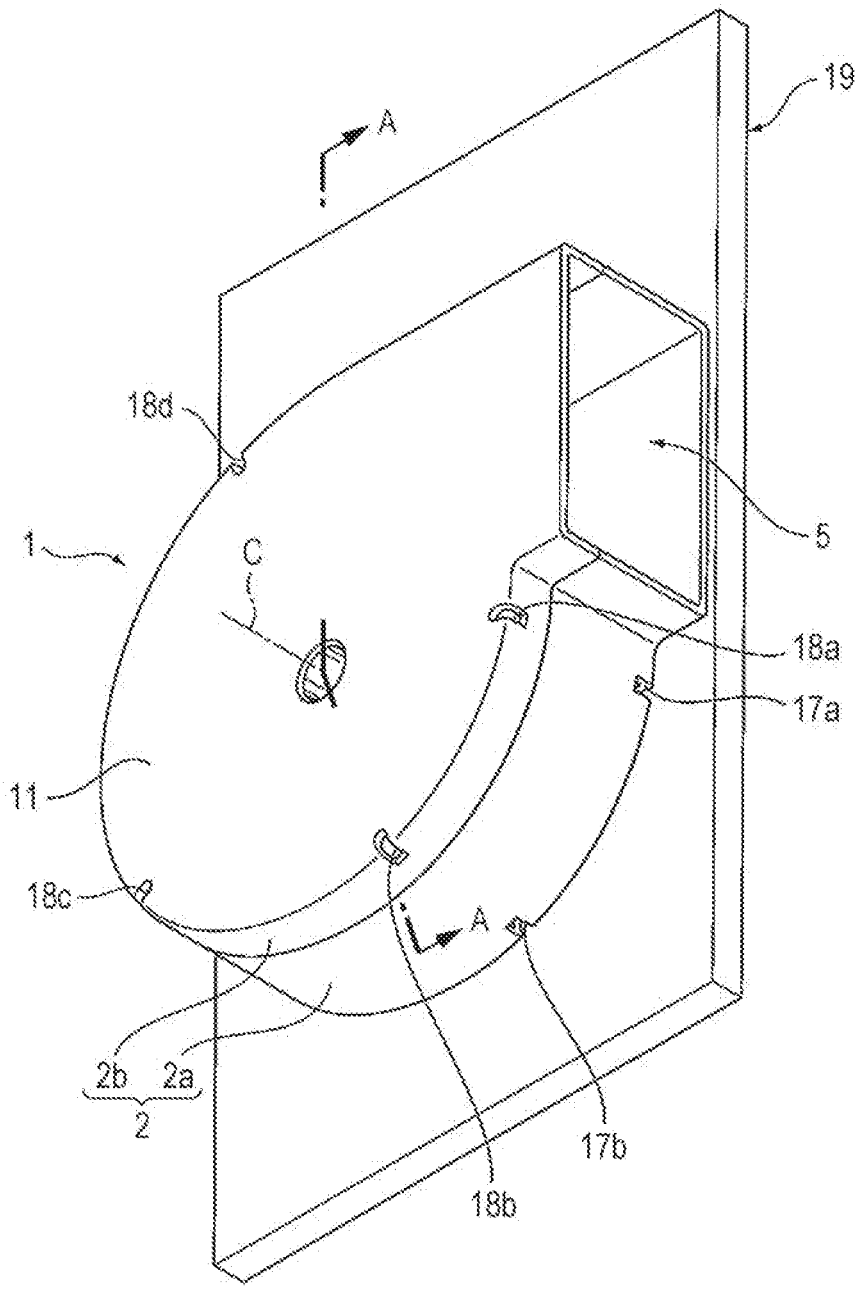
FIG. 4 is a perspective view illustrating the waterproof blower fan according to one embodiment of the present disclosure installed on a fan installation board.

FIG. 4 illustrates the inlet-side side wall portion 10 of the waterproof blower fan 1 according to the above embodiment installed on a board surface 20 of a fan installation board 19 made of sheet metal.

In FIG. 4, an outer surface of the inlet-side side wall portion 10 of the waterproof blower fan 1 is in contact with the board surface 20 of the fan installation board 19. An inlet hole 21 having substantially the same diameter as that of the inlet 4 of the waterproof blower fan 1 is formed in the fan installation board 19 (refer to FIG. 5). The inlet hole 21 provided in the fan installation board 19 and the inlet 4 of the waterproof blower fan 1 are connected so as to substantially coincide with each other. In the waterproof blower fan 1, gas is drawn into the inlet 4 of the waterproof blower fan 1 through the inlet hole 21 of the fan installation board 19 in the direction of the rotation axis C. The drawn gas is discharged from the outlet 5. At least one of the outer surface of the inlet-side side wall portion 10 and an outer surface of the nameplate-side side wall portion 11 may be in contact with the board surface 20 of the fan installation board 19 supporting the waterproof blower fan 1.

Figure 5:
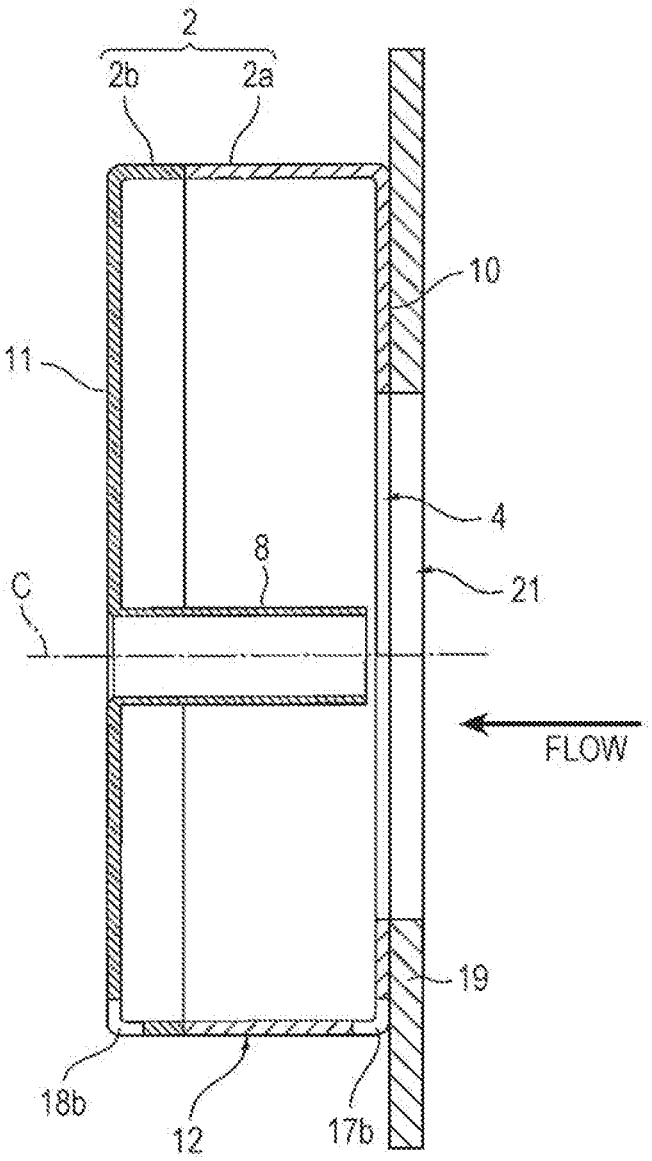
FIG. 5 is an axial cross-sectional view of the waterproof blower fan as viewed along line A-A illustrated in FIG. 4.

FIG. 5 is an axial cross-sectional view of the waterproof blower fan 1 as viewed along line A-A illustrated in FIG. 4, the line A-A passing the rotation axis C and the drain hole.

As described above, the drain holes 17*a* to 17*d* and 18*a* to 18*d* form the integral hole spaces along the corner portions formed by both the side wall portions 10 and 11 and the outer peripheral wall portion 12 of the casing 2. These drain holes 17*a* to 17*d* and 18*a* to 18*d* form hole spaces having a cross section of an equal or unequal angle (including an L shape) in cross sections that are parallel to the rotation axis C and pass the rotation axis C and the drain holes 17*a* to 17*d* and 18*a* to 18*d*.

The drain holes 18*a* to 18*d* are formed along the corner portion formed by the nameplate-side side wall portion 11 and the outer peripheral wall portion 12 so as to have a cross section of an equal or unequal angle (including an L shape). The entire portions of these drain holes 18*a* to 18*d* open to the outside. On the other hand, the drain holes 17*a* to 17*d* are provided along the corner portion formed by the inlet-side side wall portion 10 and the outer peripheral wall portion 12. The drain hole portions of these drain holes 17*a* to 17*d* in the inlet-side side wall portion 10 are blocked by the board surface 20 of the fan installation board 19. On the other hand, the drain hole portions of these drain holes 17*a* to 17*d* on the outer peripheral wall portion 12 side open to the outside. Hence, the built-up water is also discharged from the drain holes 17*a* to 17*d* on the fan installation board 19 side substantially without trouble.

In the embodiment, the inlet-side side wall portion 10 of the waterproof blower fan 1 is installed on the board surface 20 of the fan installation board 19. Conversely, the nameplate-side side wall portion 11 may be installed on the board surface 20 of the fan installation board 19. In this case, all the drain holes 18*a* to 18*d* also open to the outside. Accordingly, there is substantially no trouble in discharging the built-up water W.

In this manner, the portions of the drain holes 17*a* to 17*d* and the portions of the drain holes 18*a* to 18*d*, which correspond in pairs, communicate with each other at the corner portions formed by both the side wall portions 10 and 11 and the outer peripheral wall portion 12 to provide the drain holes 17*a* to 17*d* and 18*a* to 18*d* as the integral hole spaces. Consequently, the built-up water W is discharged from all the drain holes 17*a* to 17*d* and 18*a* to 18*d* substantially without trouble. Hence, the degree of flexibility in attachment of the waterproof blower fan 1 to the fan installation board 19 increases.

The fan installation board 19 may form a part of the structure of a building, another device, or the like as long as it allows the waterproof blower fan 1 to be attached thereto. Moreover, there is no problem in forming the fan installation board 19 into a plate shape attached to the device or the like. Furthermore, the fan installation board 19 may be made of sheet metal as described above. However, the quality, manufacturing method, and the like of the fan installation board 19 are not at all limited.

Figure 6A:
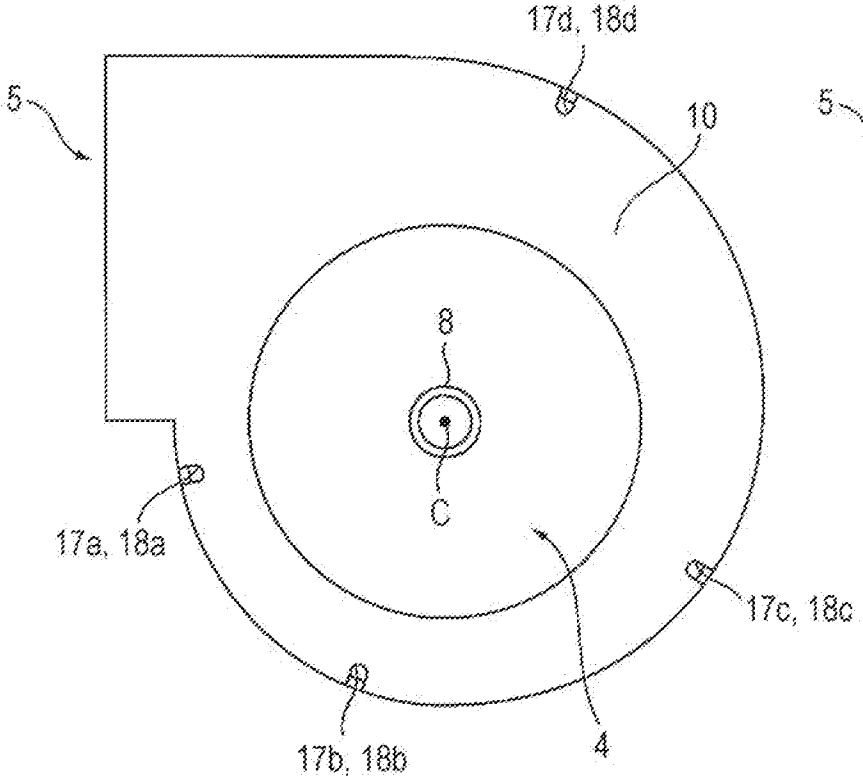

FIGS. 6A and 6B illustrate the casings 2 having different numbers of drain holes to check changes in the performance of the waterproof blower fan 1 due to changes in the number of drain holes. These drawings are front views illustrating the casing 2 as viewed from the inlet-side side wall portion 10 side.

FIG. 6A illustrates the casing 2 having eight drain holes 17*a* to 17*d* and 18*a* to 18*d*. FIG. 6B illustrates the casing 2 having 10 drain holes 17*a* to 17*e* and 18*a* to 18*e*. In terms of all the drain holes 17*a* to 17*d* (17*e*) and 18*a* to 18*d* (18*e*), the portions of the corresponding drain holes 17*a* to 17*d* (17*e*) and 18*a* to 18*d* (18*e*) communicate with each other in pairs at the corner portions formed by both the side wall portions 10 and 11 and the outer peripheral wall portion 12 to form the drain holes 17*a* to 17*d* (17*e*) and 18*a* to 18*d* (18*e*) as the integral hole spaces as in the embodiment. The cross section of these drain holes 17*a* to 17*d* (17*e*) and 18*a* to 18*d* (18*e*) has an equal or unequal angle shape.

The waterproof blower fans 1 used to check changes in the performance of the waterproof blower fan 1 have a rated output of approximately 17 W, a maximum air flow of approximately 1 $m^3$/min, and an impeller diameter of approximately 70. The waterproof blower fans 1 are approximately 100 mm×30 mm thick in terms of the outside shape. The drain holes 17*a* to 17*e* and 18*a* to 18*e* have the same structure as that of the above embodiment. The area of the openings of the drain holes 17*a* to 17*e* and 18*a* to 18*e* is approximately 21 $mm^2$.

Figure 7:
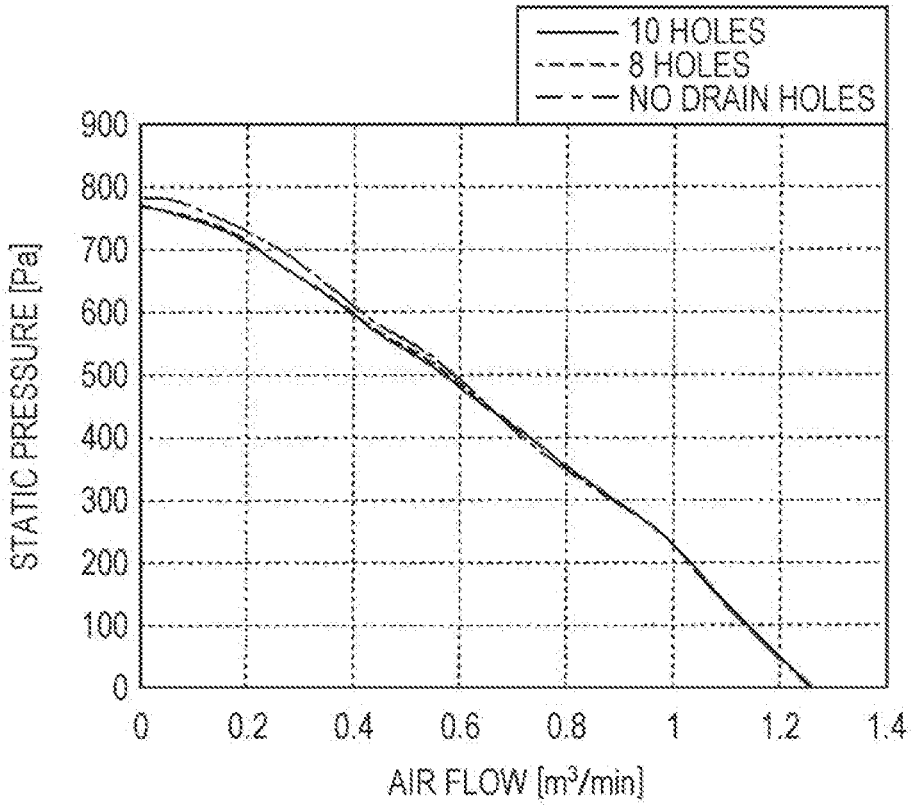
FIG. 7 is a graph illustrating the air flow-static pressure characteristic of the waterproof blower fan according to one embodiment of the present disclosure.

FIG. 7 is a graph illustrating the results of measurement of changes in characteristics of the air flow and the static pressure of the waterproof blower fan 1 in accordance with changes in the number of drain holes. In this graph, the vertical axis indicates the static pressure [Pa], and the horizontal axis indicates the air flow [$m^3$/min]. The waterproof blower fans 1 used for the measurement are the waterproof blower fan 1 having no drain holes, the waterproof blower fan 1 having the eight drain holes 17*a* to 17*d* and 18*a* to 18*d*, which is illustrated in FIG. 6A, the waterproof blower fan 1 having the 10 drain holes 17*a* to 17*e* and 18*a* to 18*e*, which is illustrated in FIG. 6B.

In the graph of FIG. 7, the measurement result of the waterproof blower fan 1 having no drain holes is indicated by a dot-and-dash line. Moreover, the measurement result of the waterproof blower fan 1 having the eight drain holes, which is illustrated in FIG. 6A, is indicated by a dotted line. Furthermore, the measurement result of the waterproof blower fan 1 having the ten drain holes, which is illustrated in FIG. 6B, is indicated by a solid line.

The results of the measurement indicate that changes in the characteristics according to the numbers (existence or nonexistence) of drain holes were few. The static pressure in a low air flow region was slightly reduced in the waterproof blower fans 1 having the drain holes as compared to the waterproof blower fan 1 having no drain holes. However, the differences between them were small. In an approximately middle to high air flow region, there were hardly any differences in the static pressure. In many cases, the air flow is set within a range of approximately 0.2 to 0.8 $m^3$/min in normal operation. It can be seen that the number (existence or nonexistence) of the drain holes hardly has a substantial influence on the air flow-static pressure characteristic in an operation in any air flow region including a region in the neighborhood of the range.

Figure 8:
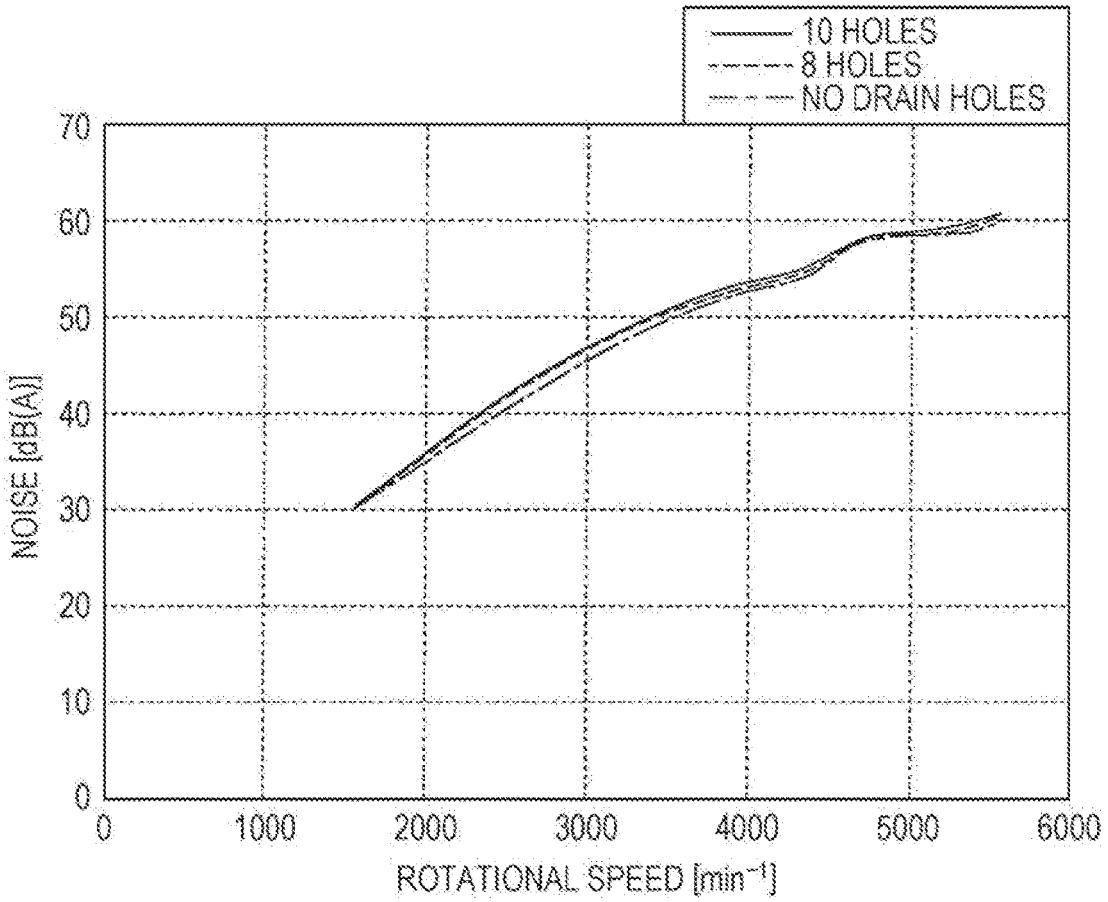
FIG. 8 is a graph illustrating the rotational speed-noise characteristic of the waterproof blower fan according to one embodiment of the present disclosure.

FIG. 8 is a graph illustrating results of measurement of changes in a relationship between the impeller speed and noise in accordance with the numbers (existence or nonexistence) of drain holes. In the measurement, the three types of waterproof blower fan 1 used for the measurement whose results are illustrated in FIG. 7 were used. In the graph illustrated in FIG. 8, the vertical axis indicates the noise level [dB(A)], and the horizontal axis indicates the rotational speed [RPM].

As in FIG. 7, in the graph of FIG. 8, the measurement result of the waterproof blower fan 1 having no drain holes is indicated by a dot-and-dash line. The measurement result of the waterproof blower fan 1 having the eight drain holes is indicated by a dotted line. Furthermore, the measurement result of the waterproof blower fan 1 having the ten drain holes is indicated by a solid line.

The results of the measurement indicate that the noise levels were slightly increased in the entire operating range in the waterproof blower fans 1 having the drain holes with increasing number of drain holes as compared to the waterproof blower fan 1 having no drain holes. However, the differences between them were small. Therefore, it can be seen that the number (existence or nonexistence) of drain holes hardly has a substantial influence on the rotational speed-noise characteristic in an operation in any rotational speed region.

Up to this point the structure of the drain holes 17*a* to 17*d* (17*e*) and 18*a* to 18*d* (18*e*) of the waterproof blower fan 1 has been described using one embodiment of the present disclosure. In the above embodiment, each of the outer peripheral wall portion 12, the inlet-side side wall portion 10, and the nameplate-side side wall portion 11 is provided with four or five drain holes (the portions of the drain holes 17*a* to 17*d* (17*e*) and 18*a* to 18*d* (18*e*)). The portions of the corresponding drain holes 17*a* to 17*d* (17*e*) and 18*a* to 18*d* (18*e*) communicate with each other in pairs at the corner portions formed by both the side wall portions 10 and 11 and the outer peripheral wall portion 12 to form the drain holes 17*a* to 17*d* (17*e*) and 18*a* to 18*d* (18*e*) as the integral hole spaces. Hence, seemingly eight or ten drain holes are provided. Regarding this, the drain holes may be provided to any one or two of the outer peripheral wall portion 12, the inlet-side side wall portion 10, and the nameplate-side side wall portion 11.

Moreover, if the drain holes are provided to any two or all of the outer peripheral wall portion 12, the inlet-side side wall portion 10, and the nameplate-side side wall portion 11, it is also possible to provide four or five drain holes in total instead of providing four or five drain holes (portions of the drain holes) to each of them. For example, it is also possible to provide four drain holes in total, one in the outer peripheral wall portion 12, two in the inlet-side side wall portion 10, and one in the nameplate-side side wall portion 11. In this manner, the number of drain holes is arbitrary as long as it agrees with the object of the present disclosure.

In any case, the number of drain holes can also be set to an arbitrary number, for example, five or more, within a range that can ensure the performance that can be used as the waterproof blower fan 1, considering, for example, the shape of the casing 2, the operating range of the waterproof blower fan 1, and the characteristics of the waterproof blower fan 1. The apparent number of drain holes may be 12 or more, or up to approximately 20 by estimation on the basis of the changes in the performance of the waterproof blower fan 1 according to the number (existence or nonexistence) of drain holes, the changes being illustrated using FIGS. 7 and 8 in the above embodiment.

Furthermore, in terms of the shape of the opening of the drain hole, any shape such as a circle, an ellipse, a triangle, a square, or a polygon can be employed. Moreover, the shape of the hole space of the drain hole is not limited to the above-mentioned shape with a cross section of an equal angle or an unequal angle (including an L shape), either. In terms of the shape of the hole space of the drain hole, any shape can be employed as long as it is a space shape that allows drainage, such as a cylinder, a cone, a prism, a right prism/cylinder, or an oblique prism/cylinder.

The embodiment relates to a waterproof blower fan that can be used even in an environment where water, a liquid, or vapor can enter the blower fan. Especially, it can also be said that the embodiment relates to the structure of drain holes that effectively discharge, for example, water building up inside a casing of a waterproof blower fan during the stop of operation (at rest).

The drain holes 17*a* to 17*d* and 18*a* to 18*d* may be provided in such a manner that the drain holes 17 and 18 provided in both the side wall portions 10 and 11 of the casing and the drain holes 17 and 18 provided on both the side wall portion 10 side and the side wall portion 11 side of the outer peripheral wall portion 12 are at the same angular positions as viewed along the rotation axis C. The drain holes 17*a* to 17*d* and 18*a* to 18*d* may be provided in such a manner that the drain holes 17 and 18 corresponding to each other in pairs at the corner portions formed by both the side wall portions 10 and 11 and the outer peripheral wall portion 12 form integral communicating hole spaces.

As viewed in the direction of the rotation axis C, the openings of the adjacent two drain holes 17*a* to 17*d* and 18*a* to 18*d* may be formed at positions where the straight lines with the lengths L1, L2, and L3 of the chords linking portions of the opening edges located on the outermost side of the casing 2, the straight lines having the shortest lengths, do not intersect with the impeller 3.

The drain holes 17*a* to 17*d* and 18*a* to 18*d* forming the integral hole spaces along the corner portions formed by both the side wall portions 10 and 11 and the outer peripheral wall portion 12 of the casing 2 may form hole spaces of an equal angle or an unequal angle (including an L shape) in cross sections that are parallel to the rotation axis C and pass the rotation axis C and the drain holes 17 and 18.

Moreover, the embodiment of the present disclosure may be the following first to seventh drain holes of a waterproof blower fan: The waterproof blower fan corresponding to the first drain holes includes a casing; a cylindrical impeller housed rotatably in the casing: an inlet and an outlet, which are provided in the casing; and a motor configured to rotationally drive the impeller, in which the casing includes: a first and a second side wall portion provided on at least both side surfaces of the impeller; an outer peripheral wall portion surrounding an outer peripheral surface of the impeller, the outer peripheral wall portion having a substantially spiral or curved shape where a distance in a radial direction from a rotation axis of the impeller increases gradually toward a downstream side; and a passage defined by the first and second side wall portions, the outer peripheral wall portion, and an outer peripheral surface portion of the impeller, the passage being configured to guide, to the outlet, gas flowing outward in the radial direction from the outer peripheral surface of the impeller, characterized in that the outer peripheral wall portion, the first side wall portion, or the second side wall portion of the casing is provided with at least four drain holes placed along a circumferential direction of the casing, the at least four drain holes communicating between the inside and outside of the casing, the at least four drain holes having openings on an inner side of the casing, and the openings of adjacent two drain holes of the drain holes as viewed in a direction of the rotation axis of the impeller are formed at positions where a straight line being a chord linking portions at opening edges located on the outermost peripheral side of the casing, the straight line having the shortest length, hardly intersects with the impeller.

The second drain holes of the waterproof blower fan are the first drain holes of the waterproof blower fan, in which the casing is provided in at least one of the outer peripheral wall portion, the first side wall portion, and the second side wall portion with the at least four drain holes placed along the circumferential direction of the casing, the at least four drain holes communicating between the inside and outside of the casing.

The third drain holes of the waterproof blower fan are the first or second drain holes of the waterproof blower fan, in which the drain holes are provided in both the first and second side wall portions.

The fourth drain holes of the waterproof blower fan are any one of the first to third drain holes of the waterproof blower fan, in which the drain holes are provided in the first side wall portion, the second side wall portion, and both side wall portion sides of the outer peripheral wall portion, and the drain holes in both the side wall portions and the corresponding drain holes provided on both the side wall portion sides of the outer peripheral wall portion communicate with each other in pairs to form integral hole spaces.

The fifth drain holes of the waterproof blower fan are the fourth drain holes of the waterproof blower fan, in which the drain holes form spaces having a cross section of an equal or unequal angle shape.

The sixth drain holes of the waterproof blower fan are any one of the first to fifth drain holes of the waterproof blower fan, in which at least one of an outer surface of the first side wall portion and an outer surface of the second side wall portion is in contact with a board surface of a fan installation board supporting the waterproof blower fan.

The seventh drain holes of the waterproof blower fan are any one of the first to sixth drain holes of the waterproof blower fan, in which the number of drain holes placed in at least one of the outer peripheral wall portion, the first side wall portion, and the second side wall portion is five.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A waterproof blower fan comprising:

a casing;

a cylindrical impeller housed rotatably in the casing;

an inlet and an outlet, which are provided in the casing; and a motor configured to rotationally drive the impeller, wherein the casing includes:

a first side wall portion and a second side wall portion, which are provided on at least both side surfaces of the impeller;

an outer peripheral wall portion that surrounds an outer peripheral surface of the impeller, has a substantially spiral or curved shape, in which a distance in a radial direction from a rotation axis of the impeller increases gradually toward a downstream side; and a passage defined by the first side wall portion, the second side wall portion, the outer peripheral wall portion, and an outer peripheral surface portion of the impeller, the passage being configured to guide, to the outlet, gas flowing outward in the radial direction from the outer peripheral surface of the impeller, the casing further includes at least four drain holes placed along a circumferential direction of the casing at irregular intervals in both side wall portion sides of the outer peripheral wall portion, the first side wall portion, and the second side wall portion of the casing, the at least four drain holes communicating between the inside and outside of the casing, the at least four drain holes each having an opening on an inner side of the casing, the at least four drain holes in both the side wall portions and the corresponding drain holes provided on both the side wall portion sides of the outer peripheral wall portion communicate with each other in pairs to form integral hole spaces, the corresponding drain holes provided on both the side wall portion sides of the outer peripheral wall portion penetrate the outer peripheral wall portion in the radial direction to open to the outside in the radial direction, the at least four drain holes in the first side wall portion penetrate the first side wall portion in a direction parallel to the rotation axis of the impeller, the at least four drain holes in the second side wall portion penetrate the second side wall portion in the direction parallel to the rotation axis of the impeller, and the openings of adjacent two drain holes of the drain holes as viewed in a direction of a rotation axis of the impeller are placed at positions where a straight line as a chord linking portions, which are located on the outermost peripheral side of the casing, of opening edges at the shortest distance hardly intersects with the impeller.

2. The waterproof blower fan according to claim 1, wherein the drain holes form spaces having a cross section of an equal or unequal angle shape.

3. The waterproof blower fan according to claim 1, wherein at least one of an outer surface of the first side wall portion and an outer surface of the second side wall portion is in contact with a board surface of a fan installation board supporting the waterproof blower fan.

4. The waterproof blower fan according to claim 1, wherein the number of drain holes placed in at least one of the outer peripheral wall portion, the first side wall portion, and the second side wall portion is five.

5. The waterproof blower fan according to claim 1, wherein the at least four drain holes includes:

a first drain hole placed, with a first interval, away from the outlet in the circumferential direction;

a second drain hole placed, with a second interval, away from the first drain hole in the circumferential direction, the second interval being greater than the first interval;

a third drain hole placed, with a third interval, away from the second drain hole in the circumferential direction, the third interval being greater than the second interval; and a fourth drain hole placed, with a fourth interval, away from the third drain hole in the circumferential direction, the fourth interval being greater than the third interval.

* * * * *